United States Patent [19]

Jensen et al.

[11] 4,189,050

[45] Feb. 19, 1980

[54] PACKING OF THE FOLDING BAG TYPE

[75] Inventors: Ole Jensen; Walther Ostmann; Erik W. Nielsen; Leif Sorensen, all of Horsens; Erik Keldmann, Jerslev, all of Denmark

[73] Assignee: Brdr. Schur International A/S, Denmark

[21] Appl. No.: 729,012

[22] Filed: Oct. 4, 1976

Related U.S. Application Data

[63] Continuation of Ser. No. 570,707, Apr. 23, 1975, abandoned.

[30] Foreign Application Priority Data

Apr. 23, 1974 [DK] Denmark ..... 2208/74

[51] Int. Cl.[2] ..... B65D 33/20

[52] U.S. Cl. ..... 206/245; 150/7; 206/632; 229/62

[58] Field of Search ..... 206/245, 260, 632; 150/7; 229/62, 80

[56] References Cited

U.S. PATENT DOCUMENTS

| | | | |
|---|---|---|---|
| 2,582,286 | 1/1952 | Schenck | 229/62 |
| 3,070,280 | 12/1962 | Richmond | 229/62 X |
| 3,301,466 | 1/1967 | Perino et al. | 229/62 |
| 3,310,225 | 3/1967 | Hoblit et al. | 229/62 |

FOREIGN PATENT DOCUMENTS

| | | | |
|---|---|---|---|
| 196011 | 4/1923 | United Kingdom | 206/260 |

*Primary Examiner*—Stephen P. Garbe

*Attorney, Agent, or Firm*—Craig and Antonelli

[57] ABSTRACT

A tobacco or similar packing of the folding bag type, i.e. comprising a strip of sheet material which is folded about a transverse folding line offset from the middle of the strip so as to present a front panel having a free top edge and a bottom edge constituted by said folding line, and a rear panel extending upwardly from said bottom edge to beyond the top edge of the front panel, the side edges of the adjacent panels being joined so as to define a flat bag portion, the rear side of which is extended into a flap portion beyond the top of the bag portion, said flap portion being folded or adapted to be folded down along the front side of the bag together with the uppermost part of the bag portion, about a second transverse folding line underneath the top edge of the front panel, and being fastened or adapted to be fastened in a releasable manner to the exterior surface of said bag portion by means of adhering fastening means. According to the invention the said fastening means are constituted by a transverse zone of adhesive applied to the exterior surface of the bag portion at such a location that the top edge of the front panel, when the bag is folded about said second transverse folding line, is situated adjacent to said transverse zone of adhesive, preferably approximately along the middle line thereof, whereby the pouch is closable in a sealed manner.

4 Claims, 8 Drawing Figures

PACKING OF THE FOLDING BAG TYPE

This is a continuation of application Ser. No. 570,707, filed Apr. 23, 1975, now abandoned.

The present invention relates to a tobacco pouch or a similar packing of the folding bag type, i.e. made of a strip of sheet material which is folded about a transverse folding line offset from the middle of the strip so as to present a front panel having a free top edge and a bottom edge constituted by said folding line, and a rear panel extending upwardly from said bottom edge to beyond the top edge of the front panel, the side edges of the adjacent panels being joined so as to define a flat bag portion, the rear side of which is extended into a flap portion beyond the top of the bag portion, said flap portion being folded or adapted to be folded down along the front side of the bag together with the uppermost part of the bag portion, about a second transverse folding line underneath the top edge of the front panel, and being fastened or adapted to be fastened in a releasable manner to the exterior surface of said bag portion by means of adhering fastening means.

The said top edge of the front panel defines the mouth of the bag portion, and the bag portion is filled with pipe tobacco or another material up to a level just underneath the said second transverse folding line. Therefore, when the pouch or bag is folded about this line, which is located underneath the said top edge, the uppermost area of both the front and the rear panel, the latter together with its said flap extention, will be folded and hereby be held together along the folding line so as to prevent the packed material from falling out of the bag portion. Normally the flap portion, upon the said folding, extends to underneath the bottom fold edge of the bag portion, and it is folded rearwardly and upwardly about this edge so as to be laid against the rear side of the bag portion, to which it is releasably fastened by means of a piece of adhesive tape secured to the exterior surface of the flap and projecting from a middle area of the free end edge of the flap portion.

Though by the folding of the top portion of the bag portion the bag is effectively closed, this closure is nevertheless not a sealed closure, and especially for aromatic materials such as tobacco it would be desirable that the pouch or bag be closed in a sealed manner at least from the moment it is filled and closed under factory conditions until it is sold a customer in a retail shop or otherwise.

It is the purpose of this invention, therefore, to provide a pouch or folding bag of the type referred to, which is closable in a substantially sealed manner and nevertheless easily openable.

According to the invention the pouch or bag of the said type is characterized in that said fastening means are constituted by a transverse zone of adhesive applied to the exterior surface of the bag portion at such a location that the top edge of the front panel, when the bag is folded about said second transverse folding line, is situated adjacent to said transverse zone of adhesive, preferably approximately along the middle line thereof. It is obtained hereby that the mouth portion of the bag portion is closed by means of the said adhering zone which holds the free edge of the front panel against the adjacent surface of the rear panel by sticking both to the latter surface and to the front side of the front panel adjacent the said free edge. Thus the mouth opening will be closed in a sealed manner along the entire width of the packing, but the mouth is nevertheless easily openable by pulling away the mouth area from the adhering zone and unfolding the packing about the said second folding line. When the packing is unfolded the adhering zone will be situated spaced from the mouth area thereof, whereby it is not liable to get covered by particles of the contents of the packing.

By way of examples the invention is described in more detail in the following with reference to the accompanying drawing, in which.

Figure 1:
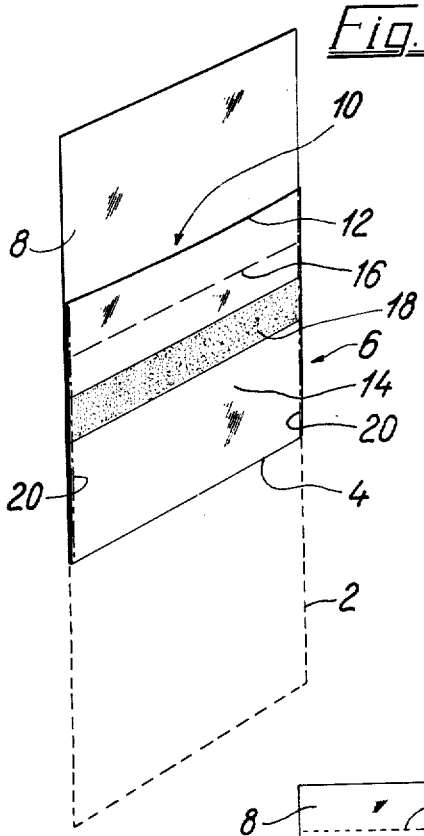
FIG. 1 is a perspective view of an empty tobacco pouch according to a first embodiment of the invention.

The pouch shown in FIG. 1 is in well known manner made of a strip of a plastic sheet material, the lower portion 2 of which is folded upwardly about a transverse bottom fold line 4 and secured by welding to the remaining strip along the side edges thereof so as to define a flat bag portion 6, the rear wall of which has an upwardly projecting flap extension 8, while a bag mouth opening 10 is formed between this rear wall and the free top edge 12 of the front panel portion, designated 14, of the bag portion. As well known, the entire sheet strip may be a double layer strip having a strip or sheet of paper interposed between the layers. The flap 8 primarily serves to facilitate the removal of minor amounts of tobacco from the pouch; it does not constitute a closing flap for the bag mouth 10, since normally the bag is closed by folding it about a transverse line 16 underneath the top edge 10.

Figure 2:
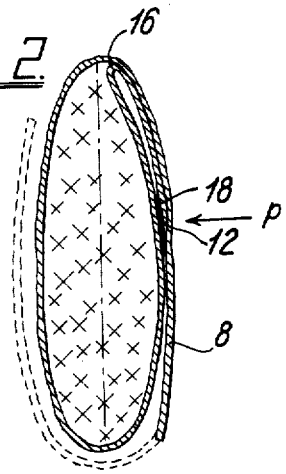
FIG. 2 is a cross sectional view of the pouch shown in filled and closed condition.

In conventional pouches the flap portion 8 is longer than shown in FIG. 1, since as shown in dotted lines in FIG. 2 it is normally long enough to be folded rearwardly about the bottom portion of the bag and upwardly along the rear side thereof. In connection with the invention, however, it will usually be possible to reduce the flap length in such a manner that the flap extends only down to adjacent the bottom area, as shown in FIG. 2, when the pouch is folded about the line 16.

The front side of the bag panel 14 is prepared or provided with a transverse zone of adhesive 18 extending all the way between the side edges of the pouch as defined by welding lines 20 and located so as to be situated adjacent the bag top edge 12 when the upper bag portion has been folded about the folding line 16. Upon this folding, therefore, the bag mouth 10 will be effectively closed when a closing pressure is applied to the outside of the folded down bag portion, as shown by the arrow p, since the edge 12 will be located approximately along the middle line of the adhering zone 18 whereby the adhesive will hold together the opposed sheet layers of the bag mouth and—of course—additionally hold these layers against the front side of the bag portion so as to stabilize the pouch in its folded condition.

For opening the pouch it is sufficient to pull the flap portion 8 forwardly, whereby the mouth area 10 is pulled away from the adhering zone 18. The pouch will be re-closable if a usual pressure sensitive adhesive is used in the zone 18. Of course the adhesive should be applied so as to remain connected to the bag portion 14 in the zone 18 when the mouth area is pulled away therefrom. This, however, is obtainable according to well known principles of preparing the sheet material so as to have increased coherence to the adhesive along the zone 18 or decreased coherence along the mouth zone.

It will be appreciated that when the pouch is open the adhesive in the zone 18 will be situated spaced from the mouth 10 so as to be unliable to receive tobacco crumbles when the pouch is in use. The adhesive, therefore, may retain its ability to close the bag mouth by repeated opening and closing thereof. Because of the bag being closed along the entire width thereof there will normally be no need to make the flap 8 longer than shown, since an additional folding of the flap about the bottom of the bag will not—as in known pouches—contribute to stabilize the closure of the bag. This feature involves a saving of sheet material.

Figure 3:
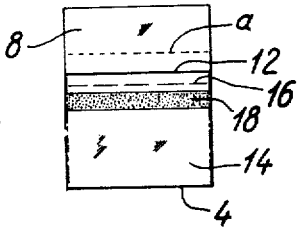
FIG. 3 is a front elevation of a slightly modified design of the pouch.
Figure 4:
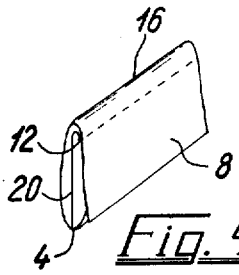
FIG. 4 is a perspective view thereof, shown in filled and closed condition.
Figure 5:
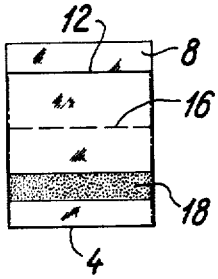
FIGS. 5 and 6 are views corresponding to FIGS. 3 and 4 respectively, of still a further modified embodiment of the invention.
Figure 6:
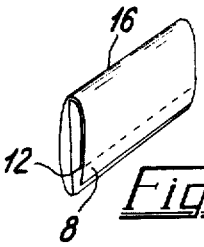

In the embodiment shown in FIGS. 3 and 4 the adhering zone 18 is situated closer to the bag top edge 12 than shown in FIGS. 1 and 2, and in the embodiment of FIGS. 5 and 6 the zone 18 is situated closer to the bottom portion of the bag. The folding line 16 is either marked on the packing or preformed as a natural fold already by the production of the pouch or by the folding and closing of the pouch in the filling plant.

The pouch may be made and folded and closed in the pouch making factory and delivered to the tobacco factory in which the pouch is filled through an open bottom or side edge portion which is thereafter closed by welding. If a bottom weld is used it may be desirable to make the flap 8 long enough to extend beyond the weld, more or less as shown in dotted lines in FIG. 2, whereby the weld line is covered by the flap when the pouch is folded together.

The packing according to the invention will be usable also for products other than tobacco and the flap 8 may be of reduced length, e.g. as shown by the dotted line a in FIG. 3, if the flap serves the only purpose of contributing to the closing of the bag mouth. However, the free edge of the flap should not be spaced from the bag top edge 12 more than corresponding to the width of the adhering zone 18, since otherwise it would be necessary to renounce either on the sealed closing of the bag mouth or on the existence of a free outer flap end not adhering to the bag, such a free flap end highly facilitating the opening of the bag.

An important aspect of the invention is the provision of a packing which may be closed sealingly after the filling thereof and remain sealed at least to the first time it is opened, whereby loss of aromatic matter is prevented during a considerable interval of time. It is less important wether good seal is obtainable by the following repeated closings of the bag, in the customer's use thereof.

It should be emphasized that the term "adhesive" or "adhering zone" as used hereinbefore should be interpreted in a rather broad sense, since it may refer to any type of material having the property of being able to hold the respective sheet surface portions adjacent the bag mouth in a releasable manner by means of a cohesion between the material in said zone and the said surface portions. For the invention it is not essential how the adhering property is or has been provided, and the adhesive should not necessarily be a separate material layer applied to the bag sheet as a substance or by way of a double adhesive tape; for example, the sheet material in the particular zone may be modified so as to show adhering properties, including an adhesion obtained magnetically or electrostatically. The prepared zone, of course, should not necessarily be confined sharply between two parallel lines.

The invention comprises both the filled and closed pouches and the pouch members prior to filling and final closing thereof, i.e. the pouch members as delivered from the bag making factory to the tobacco factory or other bag filling plant. Advantageously the pouches are produced as a continuous row of pouch members, this row being supplied to the filling plant as a reeled or a zig-zag-folded length, which in the filling plant is further processed by filling and closing of the pouch members and separating the pouches from the said row of pouch members. This may be done in a variety of different manners of which one is illustrated in FIGS. 7 and 8.

Figure 7:
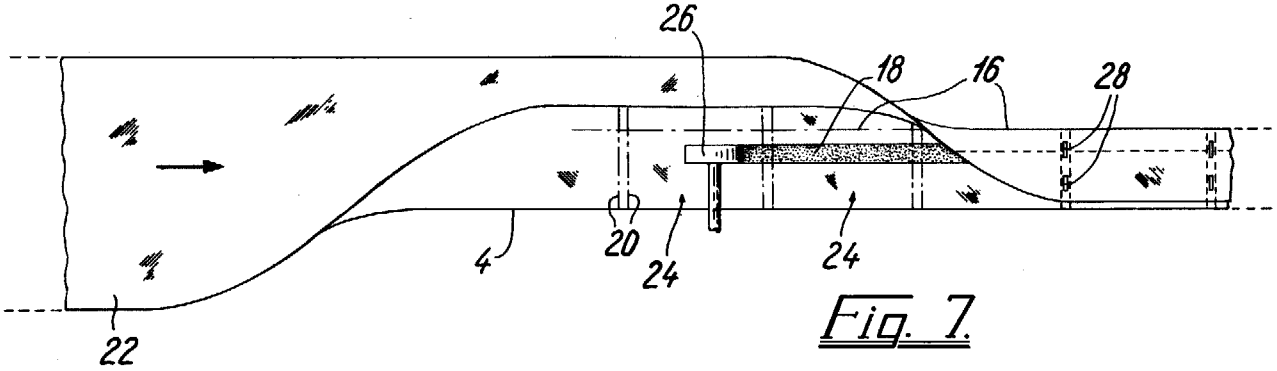
FIG. 7 is a schematic view illustrating the production of pouch members according to the invention.

FIG. 7 schematically illustrates that a moving sheet length 22 in the bag making factory is first folded about the bottom fold line 4, whereafter the folded sheet layers are welded together along two transverse welding lines 20 arranged with some mutual spacing, the consecutive pairs of welding lines 20 defining between them pouch or bag member 24. Thereafter (or prior to the provision of the welding lines 20) the adhering zone 18 is provided by spraying or rolling—by means of a wheel 26—a layer of adhesive onto the top or front surface of the folded length, and thereafter the web length is folded about the line 16, whereby the mouth areas 10 of the pouch members are closed by being pressed against the adhering zone 18. Upon this folding the sheet length passes a punching station in which one or a plurality of slots 28 is formed between each pair of adjacent welding lines 20, whereafter the length thus prepared is rolled up into a reel or folded zig-zag-wise about the transverse lines defined by the slots 28 and then delivered to the filling plant.

Figure 8:
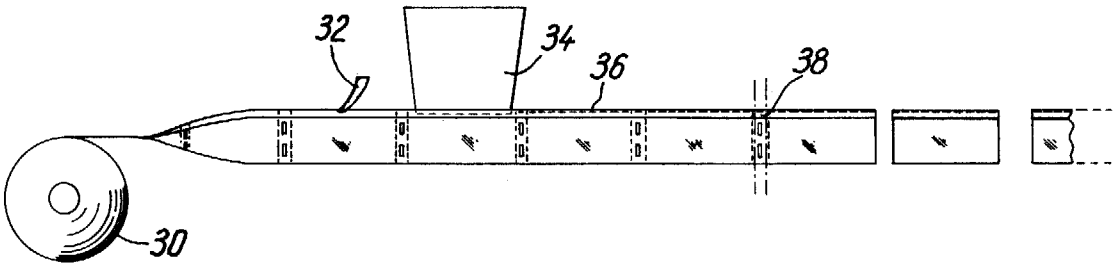
FIG. 8 is a similar view illustrating the filling and closing of the pouch members.

In the filling plant, as shown in FIG. 8, the folded length is unwound from a supply reel 30 and advanced past a stationary knife 32 cutting open the edge fold 4; of course this could be done already in FIG. 7. The web length, now with the edge 4 opened, passes a filling station 34 in which the material to be packed is filled into the bag members, from above or from the side, and then the edge 4 is closed by welding along an edge line 36. Thereafter the pouch length passes to a cutting station in which the slotted area between the side weld lines 20 is stamped away as shown at 38, or the side edges are otherwise out clean. Thereafter the single, filled pouches are ready for dispath from the filling plant. The slots 28 have served as centering means for the pouch members during their passage through the filling machine, and they may also serve to facilitate zig-zag-folding of the web delivered from the bag making machine.

Alternatively the pouch members may be delivered to the tobacco factory as a length of the configuration shown in FIG. 1, but without the adhesive having been applied thereto. The adhesive may then be applied as the length advances in the filling machine, whereby the pouches will be fillable through their mouth openings 10 and then closed by being folded about the line 16.

The adhesive may be applied already in the bag making factory if the rear side of the pouch member length is prepared in such a manner that it does not stick too firmly to the adhering zone of the length in the next winding of the material, when the length is rolled up and delivered as a reel. It will be understood that several other manners of arranging the pouch member production and the following filling and final closing of the pouches will be possible within the scope of the invention.

Generally the means for providing and processing the pouch member length according to the above principles, including the arrangements according to FIGS. 7 and 8, should need no detailed description at this place, because the different steps of folding, welding, adhesive application, cutting and filling are effectable by means well known to those skilled in the art.

What is claimed is:

1. A folding bag type pouch, comprising a strip of sheet material which is folded about a transverse folding line offset from the middle of the strip so as to define a front panel having a free top edge and a bottom edge formed by said folding line, a rear panel extending upwardly from said bottom edge beyond the top edge of the front panel to form a flap portion, the side edges of the front and rear panels being joined so as to define a flat bag, said flap portion arranged to be folded down along the front panel of the bag together with the uppermost portion of the front panel about a second transverse folding line located below the top edge of the front panel, and said flap portion and uppermost portion of the front panel arranged to be fastened in a releasable manner to the exterior surface of said bag by fastening means constituted by a transverse zone of releasable adhesive on the exterior surface of one of the panels spaced from said top edge of the front panel such that the top edge of the front panel, when the flat portion and uppermost portion of the front panel are folded about said second transverse folding line, is situated adjacent to and approximately along a middle line of said transverse zone.

2. A folding bag type pouch according to claim 1, in which a part of the flap portion is releasably fastened by a remaining portion of said transverse zone, and a part thereof extends beyond the transverse zone so as to provide an unfastened edge useable for releasing said flap portion and said top edge of the front panel.

3. A folding bag type pouch according to claim 1, in which the transverse zone of adhesive is provided on the front side of the bag portion near the top edge thereof.

4. A folding bag type pouch according to claim 1, in which the transverse zone of adhesive is provided on the front side of the bag portion adjacent the bottom edge thereof.

* * * * *